US008562295B1

(12) United States Patent
Liang

(10) Patent No.: US 8,562,295 B1
(45) Date of Patent: Oct. 22, 2013

(54) THREE PIECE BONDED THIN WALL COOLED BLADE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 576 days.

(21) Appl. No.: 12/972,761

(22) Filed: Dec. 20, 2010

(51) Int. Cl.
*F01D 5/08* (2006.01)
*F01D 5/18* (2006.01)

(52) U.S. Cl.
USPC ..... 416/97 R; 415/115; 416/97 A; 416/96 R; 416/96 A; 416/232; 29/889.21; 29/889.7; 29/889.72; 29/889.721

(58) Field of Classification Search
USPC ..... 415/115, 116; 416/97 R, 96 R, 97 A, 416/96 A, 232
See application file for complete search history.

(56) References Cited

U.S. PATENT DOCUMENTS

| | | | | |
|---|---|---|---|---|
| 5,165,852 | A * | 11/1992 | Lee et al. | 416/97 R |
| 7,296,973 | B2 * | 11/2007 | Lee et al. | 416/97 R |
| 7,303,376 | B2 * | 12/2007 | Liang | 416/96 R |
| 7,351,036 | B2 * | 4/2008 | Liang | 416/97 R |
| 7,413,407 | B2 * | 8/2008 | Liang | 416/97 R |
| 7,481,623 | B1 * | 1/2009 | Liang | 416/97 R |
| 7,690,894 | B1 * | 4/2010 | Liang | 416/97 R |
| 7,901,181 | B1 * | 3/2011 | Liang | 416/97 R |
| 7,967,566 | B2 * | 6/2011 | Liang | 416/97 R |
| 8,257,041 | B1 * | 9/2012 | Liang | 416/97 R |

* cited by examiner

*Primary Examiner* — Igor Kershteyn
(74) *Attorney, Agent, or Firm* — John Ryznic

(57) ABSTRACT

A turbine rotor blade formed from three pieces with a pressure wall side piece and a suction wall side piece bonded to an intermediate piece so that a pressure side cooling circuit can be formed as a separate cooling circuit from a suction side cooling circuit. The intermediate piece has film cooling holes and blade tip cooling holes and trailing edge exit slots formed in it that are enclosed when the outer two pieces are boded to it.

12 Claims, 7 Drawing Sheets

THREE PIECE BONDED THIN WALL COOLED BLADE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to a thin wall cooled turbine rotor blade.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A thin wall airfoil with near wall cooling can maintain a low metal temperature compared to thicker wall airfoil. However, thin wall airfoil cannot be cast because the liquid metal does not flow freely into the spaced formed by the ceramic cores in which forms the blade walls.

FIG. 1 shows a graph of a first stage turbine rotor blade external pressure profile used in an industrial gas turbine (IGT) engine. The forward region of the pressure side surface experiences high hot gas static pressure while the entire suction side of the airfoil is at a much lower hot gas static pressure than on the pressure side. Therefore, a higher cooling air pressured must exist on the pressure side than on the suction side of the airfoil to prevent the external hot gas from flowing into the airfoil internal cooling passages through film cooling holes.

FIG. 2 shows a prior art first stage turbine rotor blade 10 for an IGT engine with a (1+5+1) serpentine flow cooling circuit. This cooling circuit is formed as three separate sections and includes a leading edge section, a mid-chord section and a trailing edge section. the leading edge section includes a cooling air supply channel 16 connected by a row of metering and impingement holes to a leading edge impingement cavity 17 having a showerhead arrangement of film cooling holes to discharge the cooling air. The mid-chord section is cooled with a 5-pass forward flowing serpentine flow cooling circuit and includes a first leg of channel 11 located adjacent to the trailing edge section, a second leg 12, a third leg 13, a fourth leg 14 and a fifth and last leg 15 located adjacent to the leading edge cooling supply channel 16. Rows of film cooling holes are connected to the five legs and discharge onto the pressure side wall or the suction side wall or both walls. The trailing edge section is includes a cooling air supply channel 18 with a first row of metering and impingement holes 19 opening into a first diffusion cavity 20 followed by a second row of impingement holes 21 opening into a second diffusion cavity 22 followed by a row of trailing edge exit holes 23. FIG. 4 shows a flow diagram for the cooling circuit of FIG. 2.

Key design features for the prior art 5-pass serpentine flow cooling circuit used in the FIG. 2 blade include the following. Firstly, the forward flowing 5-pass serpentine is used in the airfoil mid-chord region. The cooling air flows toward and discharges into the high hot gas side pressure section of the pressure side. In order to satisfy the back flow margin criteria (no hot gas flows from external to internal of the airfoil), a high cooling air supply pressure is required and therefore induces a high leakage flow. Secondly, since the second leg and third leg of the 5-pass serpentine circuit provide film cooling air for both walls of the airfoil and in order to satisfy the back flow margin criteria for the pressure side rows of film cooling holes, the internal cavity pressure has to be approximately 10% higher than the pressure side hot gas side pressure. This results in an over-pressure of the airfoil suction side film cooling holes. Thirdly, a low aspect ration flow channels are used. this lowers the ceramic core yield (yield is the percent of non-defective cast blades) and making it difficult to install film cooling holes, a high inference due to the rotational effect on internal heat transfer coefficient, and also yields a low internal-to-hot gas side convection area ratio.

In a prior art two piece bonded blade, the airfoil pressure side piece is cast separate from the suction side piece. The two pieces are then bonded together through the use of TLP (Transient Liquid Phase) bonding. The benefits of manufacture for this blade with two piece construction is the use of a strong back ceramic core in the casting process that will allow for inspection of the internal cooling features and a measurement of the airfoil wall thickness prior to bonding the two pieces together and form the blade. However, a draw back for the two piece blade is a mismatch of the internal cold ribs, the complex trailing edge cooling features and around the airfoil edges during the bonding process.

BRIEF SUMMARY OF THE INVENTION

A three piece turbine rotor blade with a pressure side piece and a suction side piece bonded to an intermediate piece that separates a pressure side cooling circuit from a suction side cooling circuit. Use of the third intermediate piece will improve the airfoil bonding capability for a large frame industrial gas turbine engine turbine rotor blade. With the pressure side cooling circuit separate from the suction side cooling circuit, different cooling arrangements can be used for each side of the airfoil. The pressure side cooling circuit can be a three-pass serpentine cooling circuit while the suction side cooling circuit can be a five-pass serpentine cooling circuit.

DETAILED DESCRIPTION OF THE INVENTION

Figure 1:
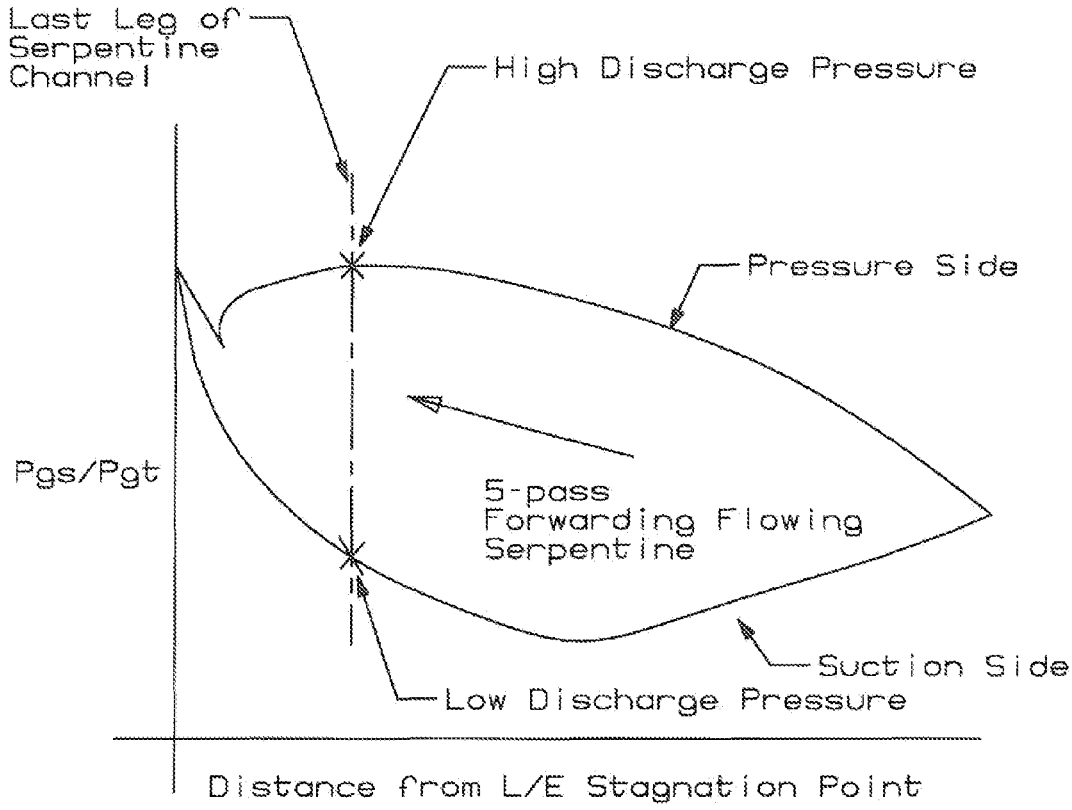
Fig 1 prior art
FIG. 1 shows an external pressure profile for a prior art first stage turbine rotor blade.
Figure 2:
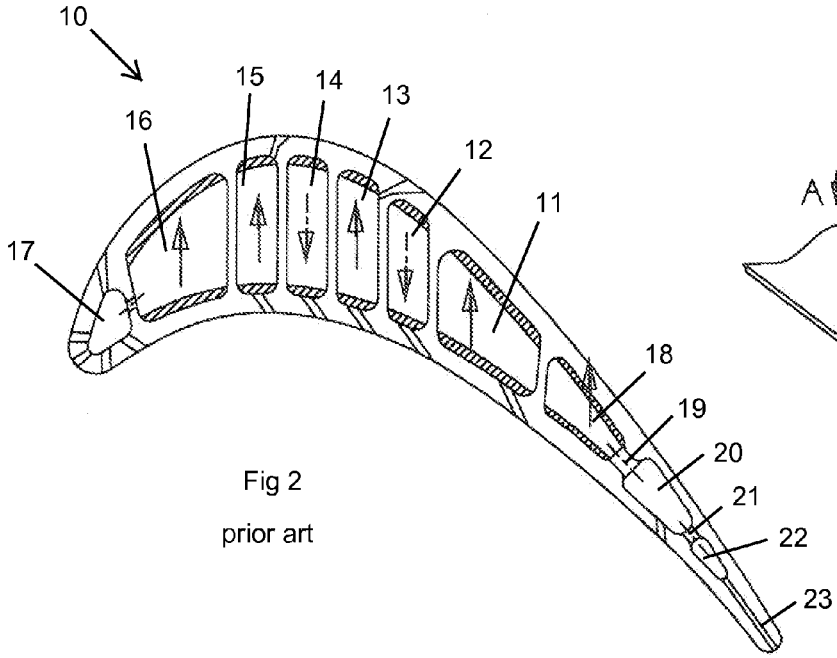
Fig 2 prior art
FIG. 2 shows a cross section view along a chordwise plane of the prior art turbine blade with the cooling circuit.
Figure 3:
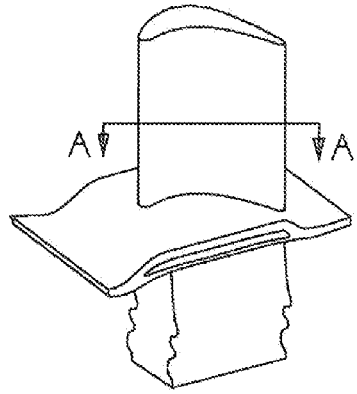
Fig 3 prior art
FIG. 3 shows an isometric view of the prior art turbine blade.
Figure 4:
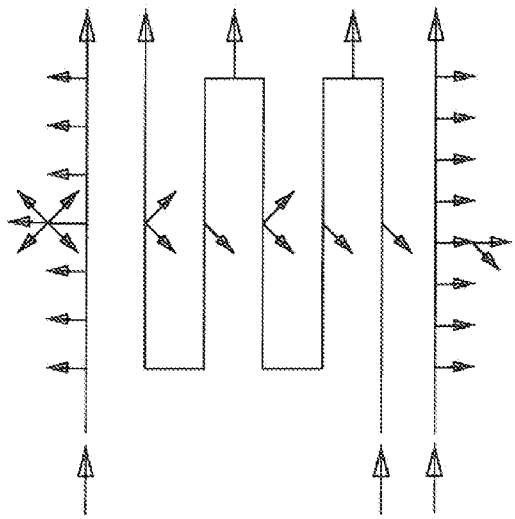
Fig 4 prior art
FIG. 4 shows a flow diagram for the prior art turbine blade of FIG. 2.
Figure 5:
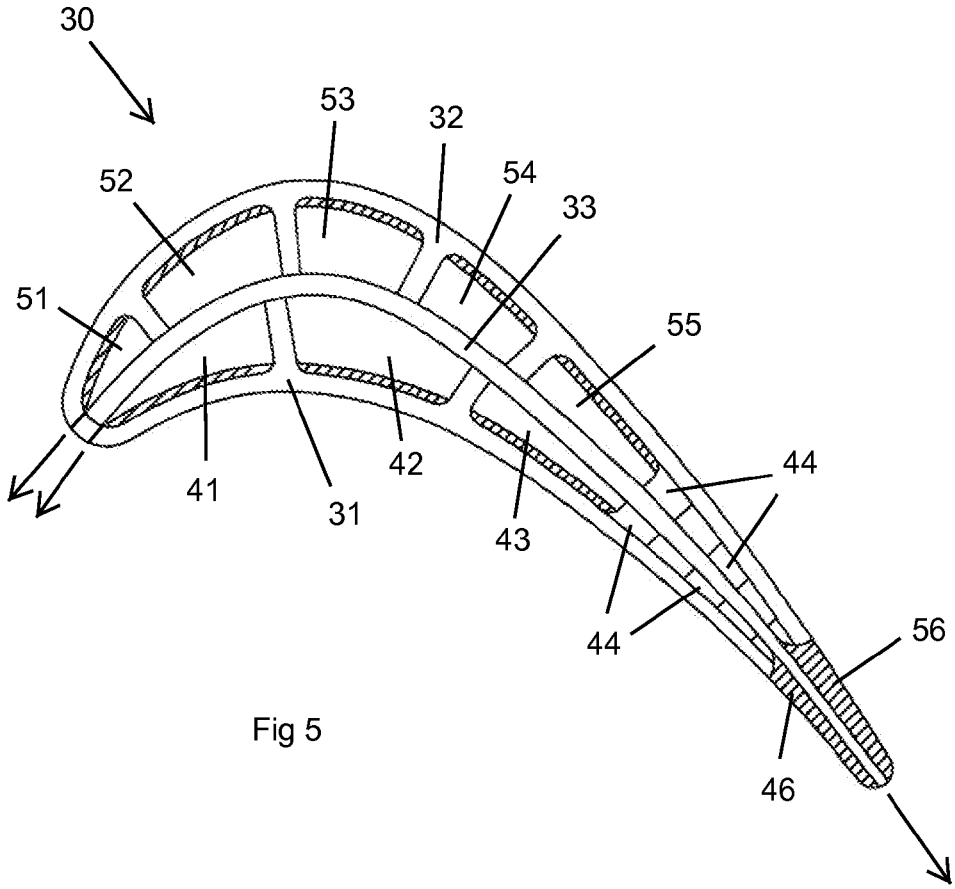
FIG. 5 shows a cross section view along a chordwise plane of the turbine blade of the present invention with the cooling circuit.

A three piece turbine rotor blade, especially for a turbine blade used in a large frame heavy duty industrial gas turbine (IGT) engine, includes a pressure side piece 31 and a suction side piece 32 bonded to an intermediate piece 33 as seen in FIG. 5. The intermediate piece 33 extends from the leading edge to the trailing edge of the blade and separates a pressure side cooling circuit from a suction side cooling circuit in that the cooling circuits do not connect so that different pressures can be used.

FIG. 5 shows the pressure side piece 31 to form a three-pass aft flowing serpentine flow cooling circuit with a first leg 41 located in the leading edge section, a second leg 42 and a third leg 43 followed by pin fins 44 extending across a pressure side trailing edge section channel. The suction side piece 32 forms a five-pass aft flowing serpentine flow cooling circuit with a first leg 51 located at the leading edge section followed by second leg 52, third leg 53, fourth leg 54 and a fifth leg 55 located along the trailing edge section. A suction side trailing edge section cooling channel also includes pin fins extending across the channel. Trailing edge pressure side stiffeners 46 are shown and suction side stiffeners 56 are shown in FIG. 5. The stiffeners 46 and 56 are formed as part of the intermediate piece 33 and form the exit slots on both the pressure side and suction side of the trailing edge section of the airfoil.

Figure 6:
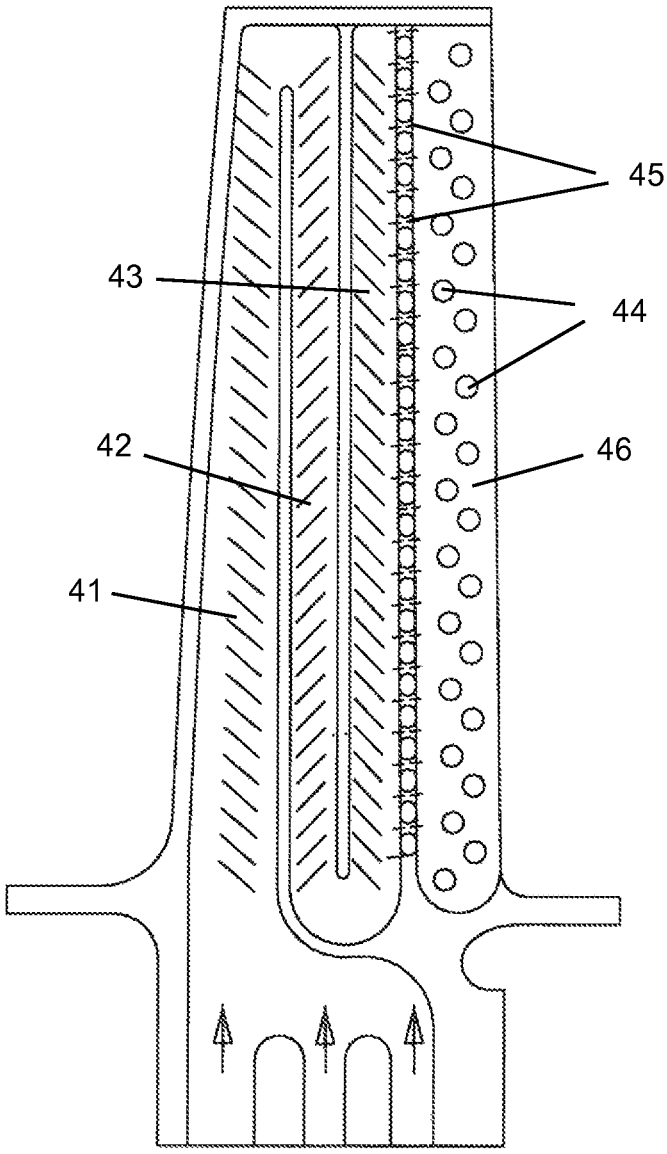
FIG. 6 shows a cross section side view of the pressure side cooling circuit for the blade of the present invention.

FIG. 6 shows a side view of the pressure side cooling circuit with the first leg 41 having fresh cooling air flowing along the leading edge wall on the pressure side of the intermediate piece 33. The second leg 42 flows up toward the blade tip and then down through the third leg 43 where the cooling air flows through the trailing edge channel on the pressure side having the pin fins 44 extending across the channel. Metering and impingement holes 45 can also be used. Trip strips are used in each of the legs of the serpentine circuit to enhance the heat transfer coefficient.

Figure 7:
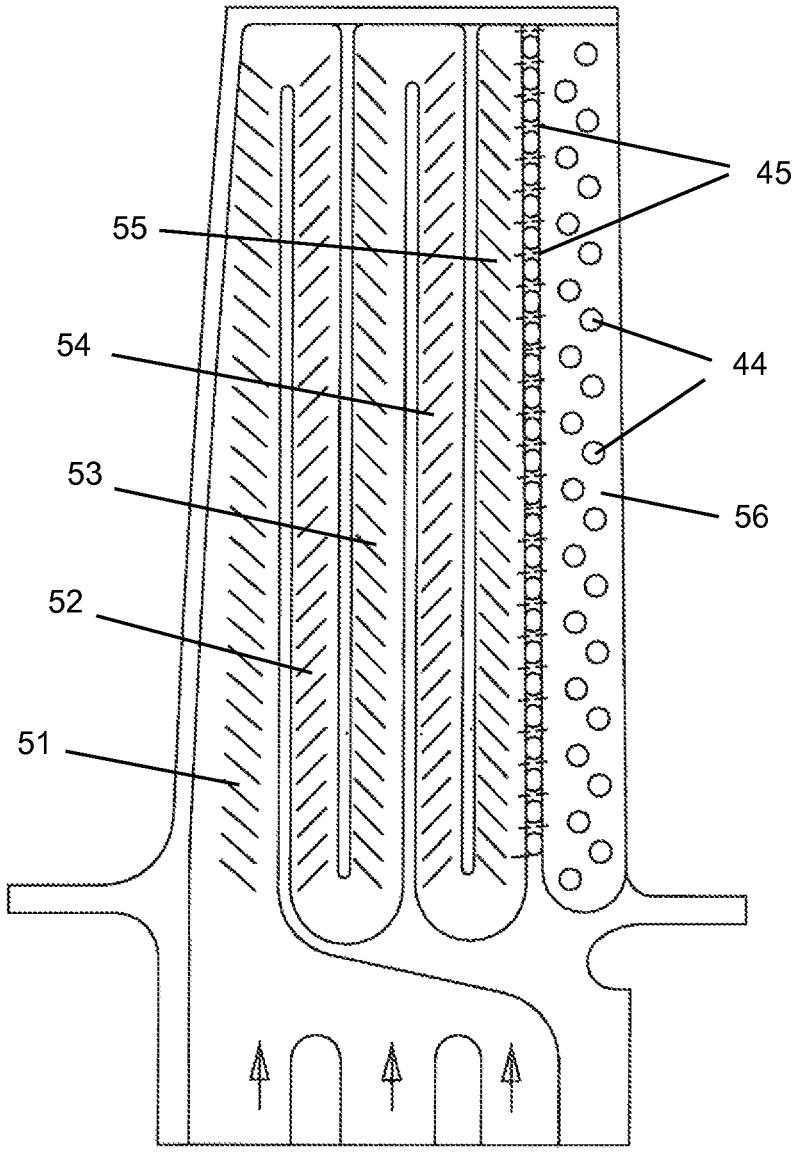
FIG. 7 shows a cross section side view of the suction side cooling circuit for the blade of the present invention.

FIG. 7 shows a side view of the suction side cooling circuit with the first leg 51 located along the leading edge wall on the suction side of the intermediate piece 33 followed by the next four legs. The fifth leg 55 discharges the cooling air through the suction side trailing edge channel having the pin fins 44 therein. Metering and impingement holes 45 can also be used. Trip strips are used in each of the legs of the serpentine circuit to enhance the heat transfer coefficient.

Figure 8:
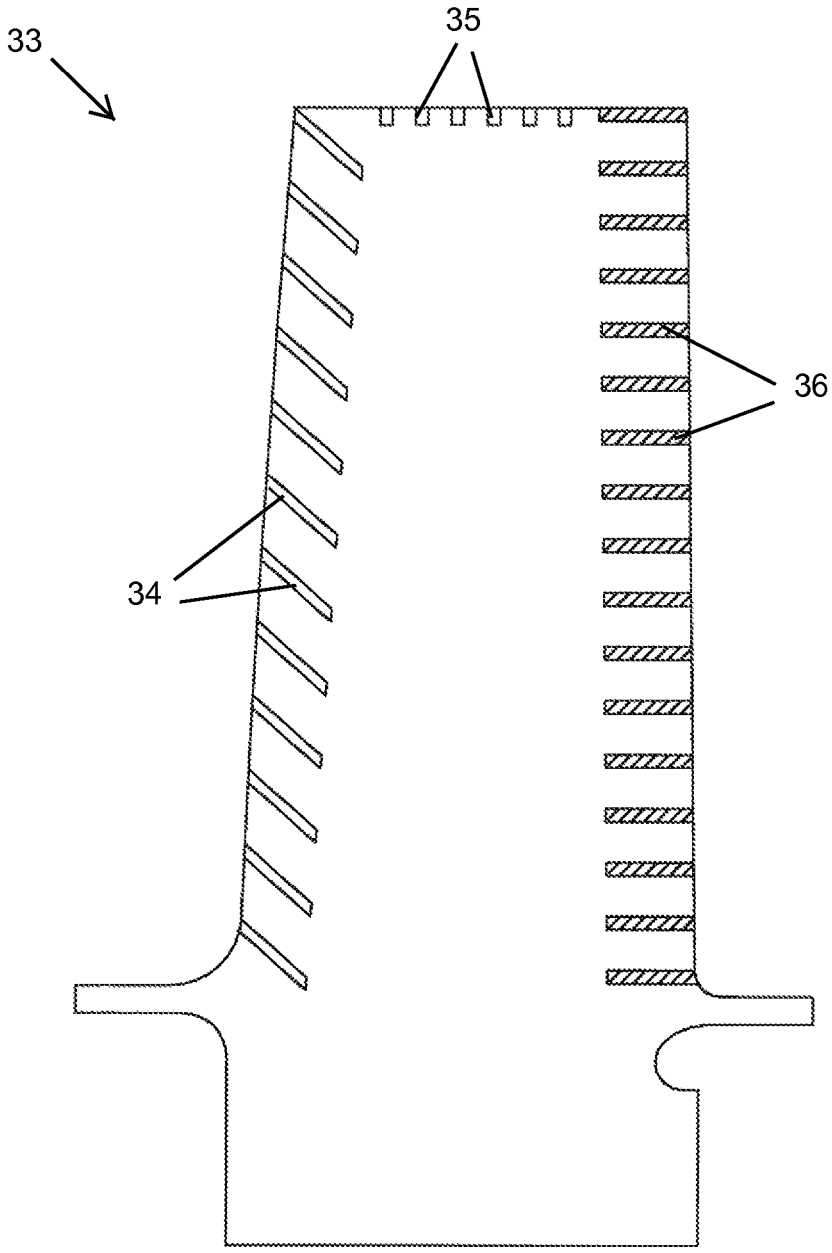
FIG. 8 shows a side view of the intermediate piece used to form the blade of the present invention.

FIG. 8 shows a side view of the intermediate piece 33 and includes a row of grooves 34 that form the showerhead arrangement of film cooling holes, grooves 35 that form tip cooling holes, and stiffeners 36 on the trailing edge section of the airfoil. The grooves 34 and 35 are formed into the two sides of the surface of the intermediate piece 33 that leave the cooling flow holes when the pressure and suction side pieces 31 and 32 are bonded to the sides of the intermediate piece 33. The stiffeners 36 form the discharge slots (slots formed between adjacent stiffeners) that open onto the pressure and suction sides of the trailing edge section of the airfoil.

Figure 9:
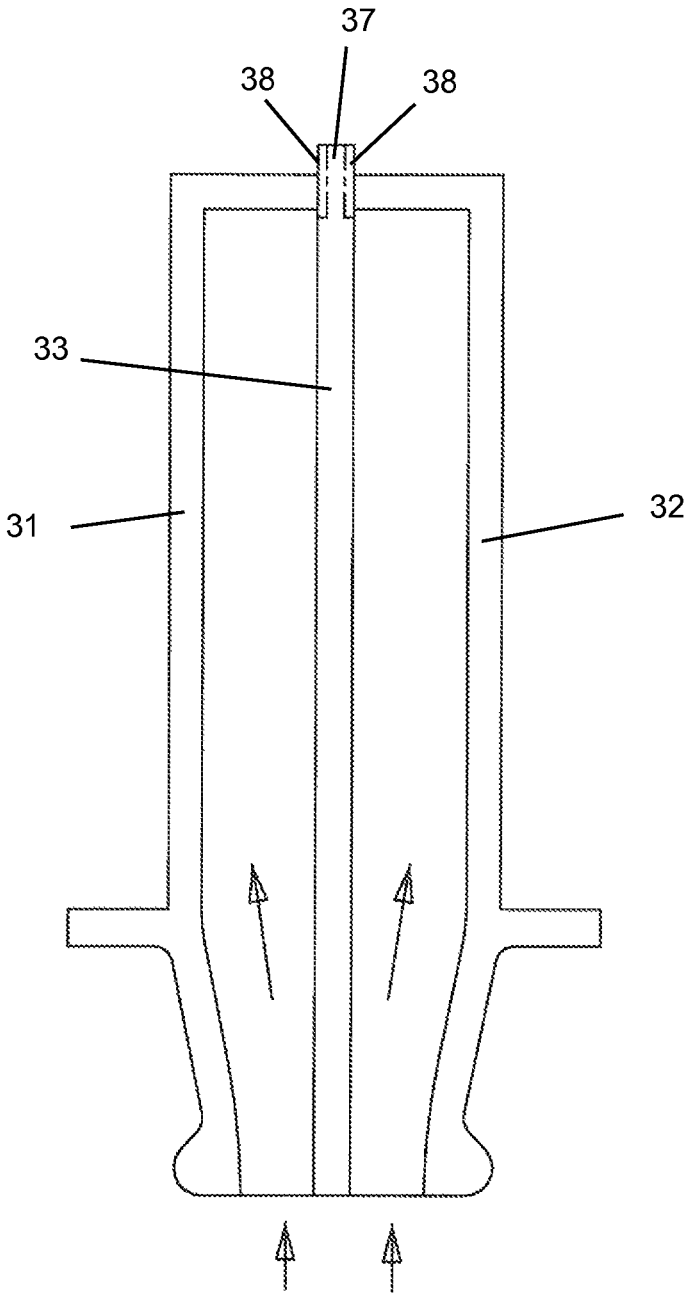
FIG. 9 shows a cross section view along a cut section across the mid-chord of the blade of the present invention.

FIG. 9 shows a view of the three piece blade with the pressure side piece 31 on the left and the suction side piece 32 on the right of the intermediate piece 33. A top end of the intermediate piece 33 includes a micro channel tip shroud 37 with cooling air slots 38 formed on the pressure side and the suction side of the tip shroud 37. These slots 38 are connected to the serpentine channels or legs of the respective circuit and discharge some of the cooling air passing through the serpentine flow circuits.

Use of the three pieces with the intermediate piece to bond the two side pieces to will solve the mismatch problem described in the prior art two piece blade. Use of the three piece bonded blade will improve the airfoil bonding capability especially for an industrial turbine blade. Cooling air supplied to the near wall serpentine flow cooling channels from the blade attachment inlet region below the blade platform will avoid having to pressurize the blade mid-chord cavity and therefore eliminate the blade tip cap and internal ribs. Micro pin fins, a roughened surface or skewed trip strips can be used in the near wall cooling channels to enhance the internal cooling performance.

The three piece bonded blade with the intermediate piece will allow for different cooling circuits to be used for each side of the airfoil. Also, cooling slots or holes can be formed onto the intermediate piece and form the enclosed slots and holes when the outer two pieces are bonded to it. The multiple pass serpentine flow cooling circuits are formed into the two outer pieces 31 and 32 while the showerhead film cooling holes, the tip cooling holes and the trailing edge cooling slots are formed into the intermediate piece 33.

The aft flowing serpentine cooling circuit used for cooling the airfoil leading edge and the airfoil main body surface will maximize the use of cooling to mainstream gas side pressure potential as well as tailor the airfoil external heat load. The cooling air is supplied at the airfoil leading edge section where the airfoil heat load and gas side pressure level are at the highest. The cooling air thus cools the hotter leading edge surface first and then serpentines through the airfoil main body surface where the heat load and gas side pressure are lower and therefore eliminating the use of film cooling holes at the forward section of the airfoil main body surface.

The cooling air serpentines through the airfoil main body surface for cooling of the blade mid-chord section, and is then discharged at the aft section of the airfoil through near wall pin fin cooling channels where the gas side pressure level is low. This yields a high cooling air to main gas stream pressure potential for use in the serpentine flow channels that maximizes the internal cooling performance for the serpentine flow cooling circuits. This design also allows for the use of a lower cooling air supply pressure and therefore a lower leakage flow than the forward flowing serpentine cooling circuits of the prior art blade.

A TLP (Transient Liquid Phase) bonding process is used to secure the two outer pieces to the intermediate piece. This eliminates any relative positioning problems with the ceramic cores in order to achieve a proper dimension alignment for the inner ribs that separate the serpentine flow channels within the airfoil. The cooling flow channels for the pressure side and suction side pieces can be cast within each of the two pieces or machined into the pieces later.

Major design features and advantages of the three piece blade and cooling circuits of the present invention over the prior art two piece blade are described below. The three-piece near wall serpentine flow cooling circuit subdivides the blade into two separate pieces with one piece having the blade leading edge region and pressure side section and another piece having the blade suction side section and the blade trailing edge region.

Each individual cooling section can be independently designed based on the local heat load and aerodynamic pressure loading conditions. The pressure side serpentine circuit begins at the leading edge region of the airfoil and ends at the trailing edge section on the pressure side wall which therefore lowers the required cooling air supply pressure and reduces the overall blade leakage flow.

The pressure side flow circuit is separated from the suction side flow circuit and therefore eliminates the blade mid-chord cooling flow mal-distribution problem due to film cooling flow mal-distribution, film cooling hole size and mainstream external hot gas pressure variation.

The pressure side flow circuit is separated from the suction side flow circuit so that the design issues associated with the back flow margin (BFM) and high blowing ratio for the blade suction side film cooling holes are eliminated.

Dividing the blade into two different cooling zones increases the design flexibility to redistribute cooling air flow and/or add cooling flow for each zone and therefore increase a growth potential (as the blade design increases in size, the cooling circuits can be easily varied to match the cooling air requirements for the larger sized blade) for the cooling circuit design.

Not using a mid-chord cooling air supply cavity for a near wall cooling circuit eliminates the inner wall of the near wall cavity submerged in-between the inner and outer walls and improves the blade TMF (Thermal Mechanical Fatigue) capability.

Eliminating the use of a mid-chord cooling air supply cavity for a near wall cooling circuit eliminates the need to pressurize an inner cavity and therefore results in minimizing a pressure gradient across the airfoil wall.

Use of the three piece bonded blade design allows for different cooling circuits to be used for both sides of the airfoil, eliminates the dimensional control and internal cooling feature dimensional mismatch requirements for the two piece prior art blade, and allows for dimensional control and measurement for the pressure and suction side wall thickness before the blade is bonded together.

Dual trailing edge discharge cooling channels provides a more uniform airfoil trailing edge metal temperature and eliminates the airfoil suction side over-temperature problem, minimizes shear mixing and therefore lowers the aerodynamic loss and maintains a high film cooling effectiveness for the airfoil trailing edge, and reduces the airfoil trailing edge thickness and therefore lowers the airfoil blockage and increases aerodynamic performance.

I claim the following:

1. A turbine rotor blade comprising:

a pressure wall side piece with a first multiple pass serpentine flow cooling channels;

a suction wall side piece with a second multiple pass serpentine flow cooling channels;

an intermediate piece with a pressure side surface and a suction side surface;

the pressure wall side piece is bonded to the pressure side surface of the intermediate piece;

the suction wall side piece is bonded to the suction side surface of the intermediate piece; and, an arrangement of film cooling holes and blade tip cooling holes and trailing edge exit slots are formed when the three pieces are bonded together.

2. The turbine rotor blade of claim 1, and further comprising:

the film cooling holes and the tip cooling holes and the exit holes are formed on the intermediate piece and enclosed by the pressure wall side piece and the suction wall side piece.

3. The turbine rotor blade of claim 1, and further comprising:

the intermediate piece includes a top end with a tip shroud and cooling slots on both the pressure side and suction side of the tip shroud.

4. The turbine rotor blade of claim 1, and further comprising:

the pressure wall side cooling circuit is separate from the suction wall side cooling circuit by the intermediate piece.

5. The turbine rotor blade of claim 1, and further comprising:

the intermediate piece includes a platform piece and a root section piece of the blade.

6. The turbine rotor blade of claim 1, and further comprising:

the blade is without film cooling holes in the mid-chord region on the pressure wall side and the suction wall side of the airfoil.

7. The turbine rotor blade of claim 1, and further comprising:

the arrangement of film cooling holes includes a first row of film cooling holes located on a pressure side of a stagnation line and second row of film cooling holes located on a suction side of the stagnation line.

8. The turbine rotor blade of claim 1, and further comprising:

the first multiple pass serpentine flow cooling channels is a three-pass aft flowing serpentine circuit; and, the second multiple pass serpentine flow cooling channels is an aft flowing five-pass serpentine circuit.

9. A process of manufacturing a turbine rotor blade comprising the steps of:

forming a pressure side piece having an outer surface forming a pressure side surface of the blade and an inner surface forming a first serpentine flow cooling circuit;

forming a suction side piece having an outer surface forming a suction side surface of the blade and an inner surface forming a second serpentine flow cooling circuit;

forming an intermediate piece having a airfoil leading edge side and an airfoil trailing edge side;

forming a row of film cooling holes on the leading edge side of the intermediate piece;

forming a row of exit slots on a pressure side of the intermediate piece;

forming a row of exit slots on a suction side of the intermediate piece; and, bonding the pressure side piece and the suction side piece to the intermediate piece to enclose the serpentine flow cooling circuits and the film cooling holes and the exit slots.

10. The process of manufacturing a turbine rotor blade of claim 9, and further comprising the steps of:

forming stiffeners on the pressure side and the suction side of the intermediate piece in the trailing edge section that form the exit slots when the pressure and suction side pieces are bonded to the intermediate piece.

11. The process of manufacturing a turbine rotor blade of claim 9, and further comprising the steps of:

forming pin fins on the pressure side piece and the suction side piece in a trailing edge region prior to bonding the pressure and suction side pieces to the intermediate piece.

12. The process of manufacturing a turbine rotor blade of claim 9, and further comprising the steps of:

not forming any film cooling holes on the pressure side wall or the suction side wall of the airfoil mid-chord section.

* * * * *